United States Patent [19]

Justus

[11] 4,030,971

[45] June 21, 1977

[54] SYSTEM COMPENSATING FOR PRESSURE FLUCTUATIONS IN A PAPER MACHINE HEADBOX

[75] Inventor: Edgar J. Justus, Beloit, Wis.

[73] Assignee: Beloit Corporation, Beloit, Wis.

[22] Filed: Oct. 29, 1975

[21] Appl. No.: 626,824

Related U.S. Application Data

[63] Continuation-in-part of Ser. No. 532,647, Dec. 13, 1974, abandoned.

[52] U.S. Cl. ..... 162/216; 162/340; 162/341

[51] Int. Cl.[2] ..... D21F 1/06

[58] Field of Search ..... 162/216, 336, 340, 341, 162/343, 347, 259

[56] References Cited

UNITED STATES PATENTS

| | | | |
|---|---|---|---|
| 3,247,049 | 4/1966 | McKie et al. | 162/340 X |
| 3,573,160 | 3/1971 | Lopas | 162/341 X |
| 3,649,446 | 3/1972 | Makela | 162/340 X |
| 3,853,694 | 12/1974 | Parker | 162/341 X |
| 3,856,619 | 12/1974 | Davidson et al. | 162/336 X |

*Primary Examiner*—S. Leon Bashore
*Assistant Examiner*—Marc L. Caroff
*Attorney, Agent, or Firm*—Hill, Gross, Simpson, Van Santen, Steadman, Chiara & Simpson

[57] ABSTRACT

A method and mechanism for compensating for pressure fluctuations in a paper machine stock flow system for conducting stock from a supply pump to a slice opening including providing a flexible diaphragm as one wall of the stock conduit with the diaphragm dampening pressure variations and being supported on its opposite side by air in an air chamber divided into compartments with a support compartment immediately opposite the diaphragm and a supply compartment behind the support compartment and the compartments divided by an attenuator wall. Air is supplied continuously at a reference pressure to the supply compartment, and a relief valve is positioned in the support compartment with the port opened or closed by movement of the diaphragm so that air is bled from the support compartment as the diaphragm moves toward the stock conduit with a drop of pressure therein. In another form, the structure includes a diaphragm wall between a distribution chamber of a headbox and an air chamber with a valve controlling the release of pressure from the air chamber and controlled by the position of the diaphragm.

18 Claims, 13 Drawing Figures

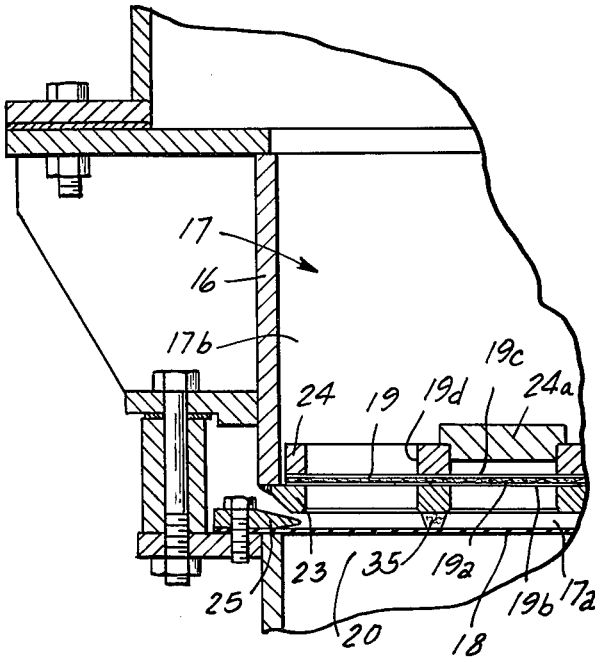
Fig. 3
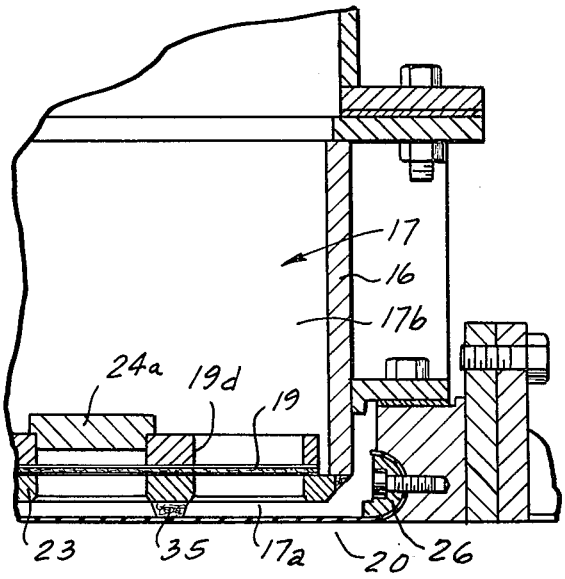
Fig. 4
Fig. 5
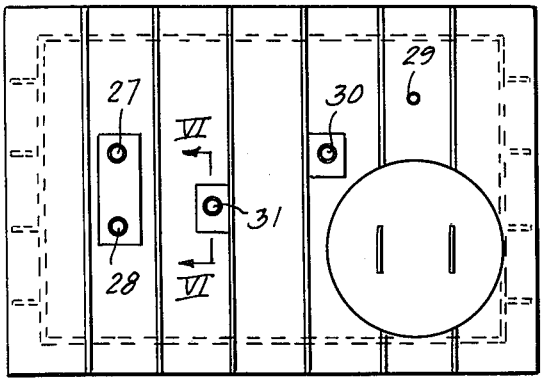
Fig. 6
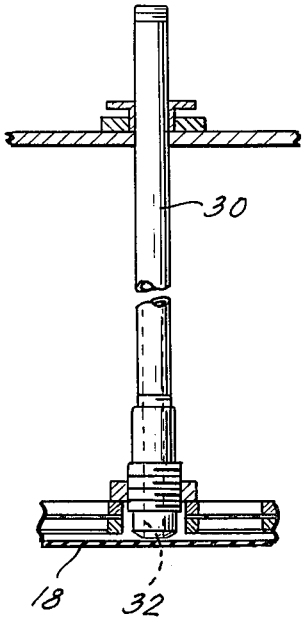

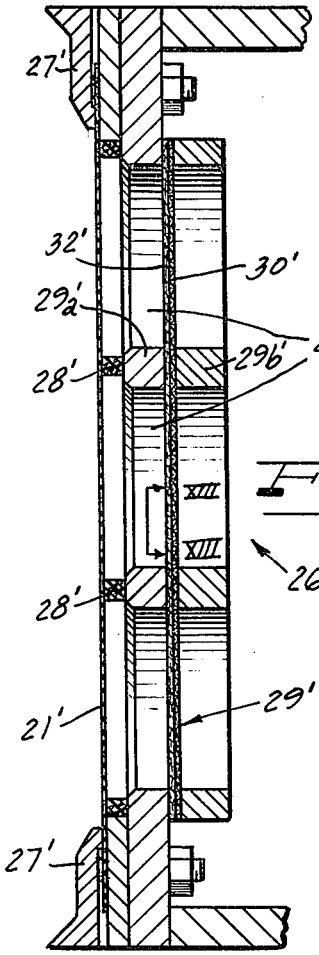
Fig. 10
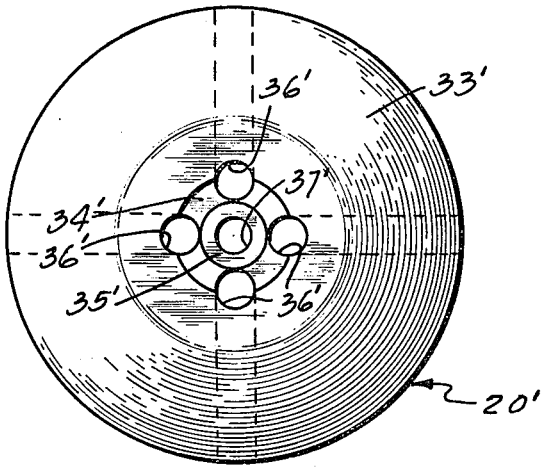
Fig. 12
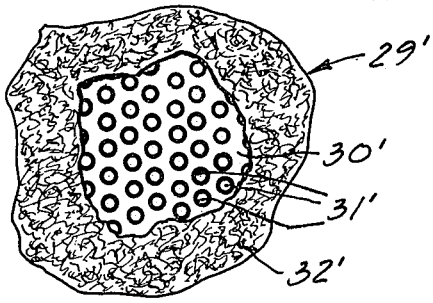
Fig. 13
Fig. 11
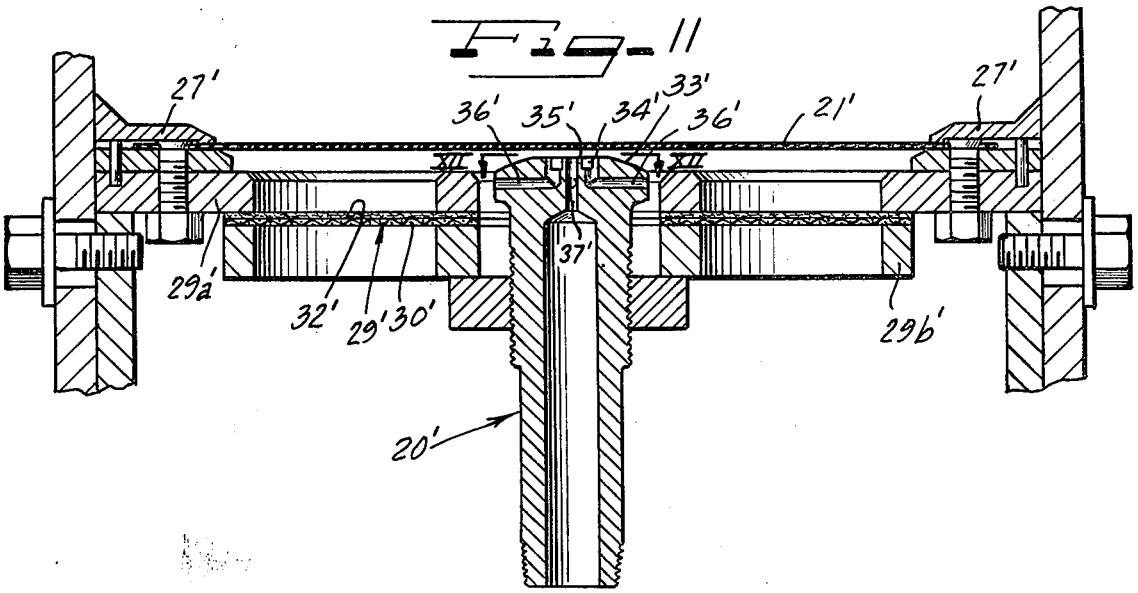

SYSTEM COMPENSATING FOR PRESSURE FLUCTUATIONS IN A PAPER MACHINE HEADBOX

This application is a continuation-in-part of my copending application, Ser. No. 532,647, filed Dec. 13, 1974, now abandonded.

BACKGROUND OF THE INVENTION

This invention relates to improvements in paper making machines, and more particularly to a stock flow system for use in a paper machine headbox installation and located between the stock supply pump and the slice chamber wherein sudden pressure changes or surges are dampened or minimized.

The features of the invention find particular utility and advantages in a paper making machine, and will be described in that environment, although it will be understood that features may be employed for other uses.

In commercial paper making machines, the stock slurry generally is delivered from a fan pump under pressure through a system through a headbox into a slice chamber and out through a slice opening. The design of the flow system and of the headbox is concentrated to give uniform flow characteristics across the entire width of the headbox to the slice opening and to avoid any local deviations or nonuniformities which are caused by nonuniform flow. One of the objectives is to avoid any nonuniformity which might be caused by sudden pressure changes or pulses in the stock flow. Such pressure pulses or surges are caused by normal hydraulic problems of operating machinery, and for example, are caused by normal vibrations or pulsations of the fan pump. They are also introduced by cleaners, screens, stock system resonances, valves and other structures which are required in the stock delivery system which conducts the stock under pressure through the piping and headbox and through the slice opening onto the forming wire. Unless the surges and pulsations in pressure are reduced or eliminated, they can cause basis weight fluctuation, particularly in a machine direction and possibly in a cross-machine direction.

A high speed commercial paper making machine presents a relatively sensitive instrument in that the phenomena of hydraulic surges and pressure fluctuations cannot be predicted by advance design. Further, optimum operation with a minimum of hydraulic surge fluctuation can occur at one set of conditions where the machine is operating at a certain pressure and flow rate and with a certain type of stock, and with change in any one of the factors, surging or pulsation can begin occurring so that it is highly desirable to provide an arrangement which will automatically function to dampen the pressure pulses which can occur and to achieve this dampening over the wide range of operational circumstances expected during operation of a commercial machine.

It is accordingly an object of the present invention to provide a surge dampening device which will maintain uniform pressure with an absence of pressure surges and fluctuations and which will attenuate such fluctuations during operation of the paper making machine so that uniform pressure will be maintained in the pressurized stock flow from the stock supply system to improve uniformity of paper web formation.

A further object of the invention is to provide a surge attenuating construction which eliminates the problems of the surging devices heretofore available that tend to foul up and become inoperative due to the accumulation of stock fibers, and to provide a structure which offered substantially no requirements for change in design of the paper stock flow system to the headbox.

A further object of the device is to provide an improved surge dampening device which is capable of being automatically and readily changed to variations in stock flow pressures and which operates successfully and satisfactorily over a wide range of delivery pressures.

A still further object of the invention is to provide a surge dampening device wherein the structure will operate stably and not introduce vibrations, surges or pressure fluctuations of its own and which will operate reliably and controllably over a long period of time without requiring servicing or attention.

A further object of the invention is to provide a surge dampening method and device having operating principles which make it capable of being used in various locations in the stock supply system including the supply piping leading to the headbox, and which can be constructed and installed without requiring a large amount of extra space so that it can be designed into existing headbox systems.

Other objects, features and advantages will become more apparent, as will equivalent structures and methods which are intended to be covered herein, from the teaching of the principles of the invention connected with the disclosure of the preferred embodiments thereof in the specification, claims and drawings, in which:

DRAWINGS

FIG. 3 is an enlarged fragmentary sectional view taken substantially along line III—III of FIG. 1;

FIG. 4 is an enlarged fragmentary view taken substantially along line IV—IV of FIG. 2;

FIG. 5 is a plan view taken substantially along line V—V of FIG. 1;

FIG. 6 is a fragmentary sectional view taken substantially along line VI—VI of FIG. 5;

FIG. 10 is a more detailed sectional view taken substantially along line X—X of FIG. 9;

FIG. 11 is an enlarged sectional view taken substantially along line XI—XI of FIG. 8;

FIG. 12 is an enlarged sectional view taken substantially along line XII—XII of FIG. 11; and FIG. 13 is a sectional view taken substantially along line XIII—XIII of FIG. 10.

DESCRIPTION

Figure 1:
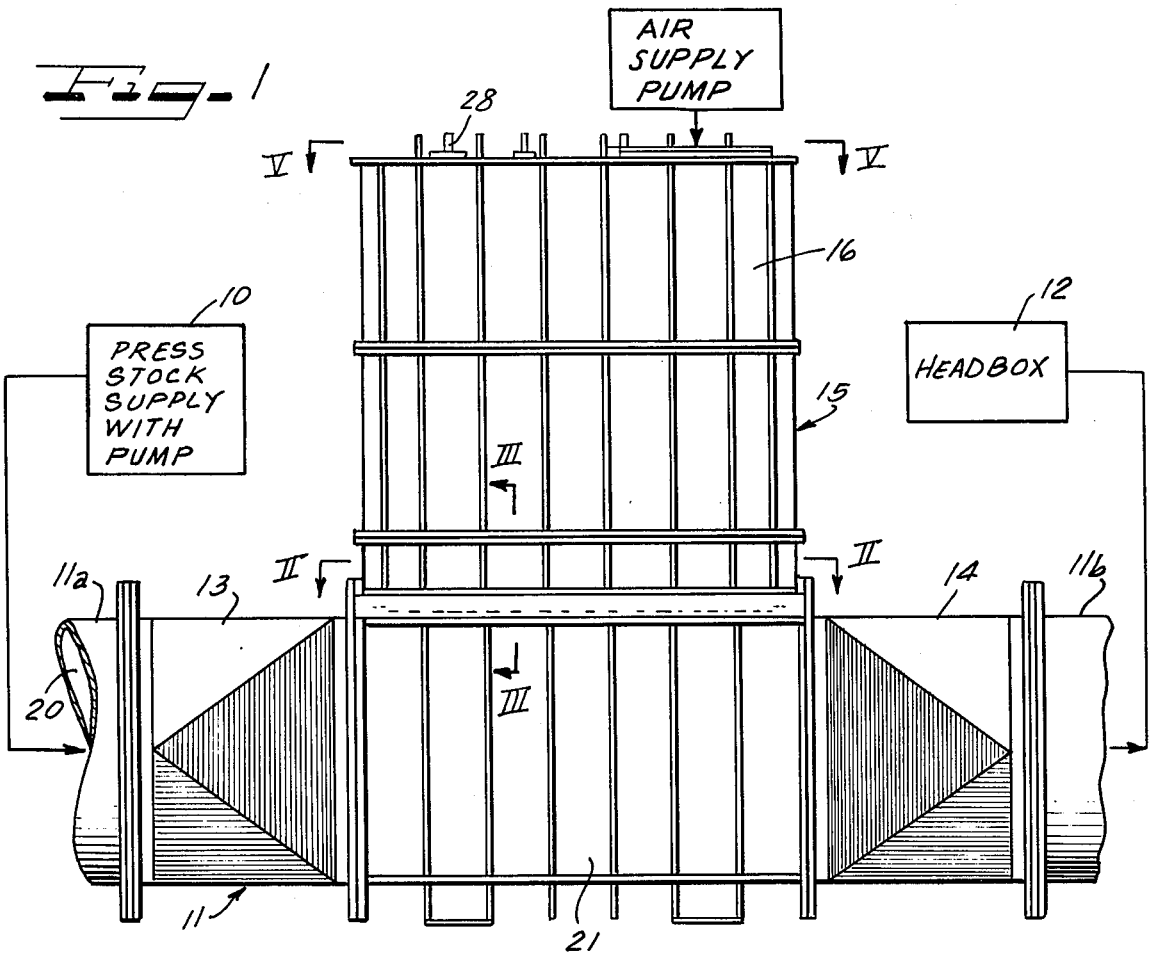
FIG. 1 is an elevational view, of a portion of a paper stock supply system illustrating a stock pulse attenuator system constructed and operating in accordance with the principles of the invention in operating location.

As illustrated in FIG. 1, a stock supply conduit system is provided for conducting stock from a pressure stock supply 10, such as a fan pump, to a headbox 12. The conduit arrangement is shown at 11 and usually will be of circular piping with the stock flowing through the interior at 20. Circular pipes 11a and 11b are fitted with intervening conversion piping sections 13 and 14 which convert the circular piping to a rectangular for fitting the attenuator housing 16 in place, and convert the flow back to circular through the fitting 14.

The pulse attenuator housing 16, as illustrated in FIGS. 1, 3 and 4, defines a chamber 17 therein. Because the housing may be formed of various structural framing pieces suitable for attachment to a rectangular section of piping, the details of the housing construction need not be described, and variations will be apparent to those versed in the art from the teachings contained herein.

Figure 2:
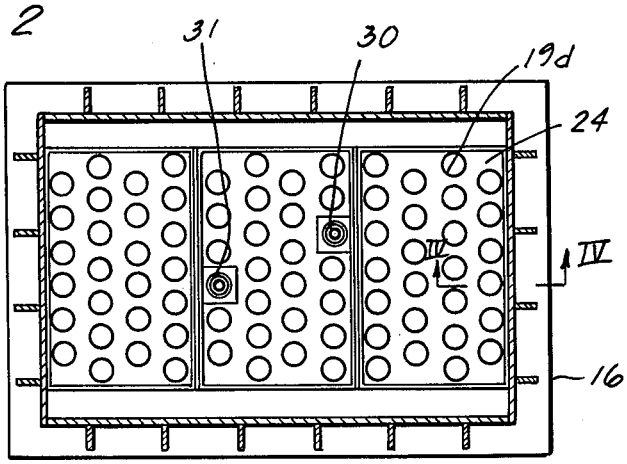
FIG. 2 is a horizontal sectional view taken substantially along II—II of FIG. 1.

The attenuator is arranged so that a flexible diaphragm 18 forms one wall of a rectangular chamber 21 through which the stock flows. The diaphragm 18 is rectangular in shape and forms the entire wall facing the stock flow. The diaphragm is backed over its entire surface by air under pressure and pulsations or surges in stock pressure are absorbed by the air backed diaphragm. The air is compressible, and forms a resilient overall support. Generally, fluctuations in pressure in the stock as it flows through the rectangular chamber 21 will be absorbed by the diaphragm 18, and if the stock pressure decreases, the diaphragm 18 will move toward the stock flow, and if the stock pressure increases, the diaphragm will move away from the stock flow to attenuate these pressure changes. For improving the attenuation function and avoiding fluttering or pulsation of the diaphragm, the air chamber 17 is divided into a first diaphragm support compartment **17*a* and a second supply compartment 17*b*. These compartments are separated by an attenuator wall 19 which is formed of an attenuator felt which prevents surges of air between the two compartments. The attenuator wall 19 can take different forms to permit passage of air between the compartments 17*a* and 17*b*, but prevent rapid surges therebetween. In the preferred form, the wall 19 is in the form of a felt 19*a* supported between perforate plates or screens 19*b* and 19*c*. The screens are clamped between plates 23 and 24 which have circular holes therein, such as 19*d*, as illustrated in FIGS. 2, 3 and 4**.

Control of the attenuation of the flow of air between the compartments **17*a* and 17*b* may be obtained by selecting plates with holes of a different size or by changing the character of the felt. However, a change in the attenuation effect during operation may be provided by furnishing plugs 24*a*** which can fit into the holes, and the number of plugs which will be inserted will determine the overall open area between the compartments.

The diaphragm 18 is formed of a relatively heavy or rugged material such as rubber, suitably clamped at its edges to prevent leakage of air into the stock stream and leakage of stock into the air compartment. A clamping arrangement is shown at 25 at one edge in FIG. 3, and another form of clamping arrangement is shown at 26 at another edge in FIG. 4.

Air is supplied to the air chamber 17 through a fitting at 29 to maintain a continuous supply at a predetermined reference pressure. Normally a continual flow of air will be maintained in the chamber at a reference pressure, and excess air will be bled out from the chamber through an air release valve 30, FIG. 5. Additional vents 27 and 28, FIG. 5, may be provided having valves which may be quickly opened for quick discharge of the system should this become necessary.

The air release valve 30 is operated by the diaphragm, and for this purpose has an opening 32 which is normally just barely maintained in a closed position by the diaphragm resting against the opening 32. A duplicate valve 31 is provided in the air chamber, also controlled by the diaphragm in order to have a second valve available for better control, and for a backup.

In operation air will be introduced continually into the chamber 17 through the supply 29 up to where the pressure in the air chamber equals the pressure in the stock distribution chamber 20 on the other side of the diaphragm. At that point, the diaphragm is barely touching the valve head 30 to barely maintain the valve port 32 in a closed position. Any unintended excess pressure in the air chamber will tend to move the diaphragm away from the valve opening 32 to bleed the air out through the relief valve 30. The stem of the relief valve leads to atmosphere, passing through the wall of the housing 16. Thus, equilibrium conditions and an equilibrium position of the diaphragm 18 is maintained during operation.

This permits the diaphragm to perform its intended purpose of reducing the air pressure rapidly within the chamber 17 when the fluid pressure in the stock distributor chamber 20 suddenly drops. This maintains the flow rate and the pressure in the stock supply as constant as possible. Similarly, any surges and increases in pressure in the stock supply chamber 20 will distend the diaphragm forcing it toward the air chamber compressing the air therein so that the pressure surge is taken up by the diaphragm to maintain the stock supply pressure and stock flow rate as uniform as possible. Circular support members 35 of foam material are positioned beneath the diaphragm on the plate 23.

The air supply to the inlet 29 is provided by suitable mechanism, not shown, which is provided with a controllable pressure regulator so that a constant supply of air is available which may be admitted only intermittently, but does maintain a reference pressure based on the desired stock fluid flow pressure. The air supply is constant only up to the reference pressure.

The arrangement described herein is a preferred construction wherein the attenuation of the stock flow pressure is maintained in a supply line leading from the fan pump 10 to the headbox 12, but the principles of the concept are also employed wherein the diaphragm support is utilized at other points in the delivery system, such as the headbox itself. In the arrangement disclosed herein wherein the attenuator is positioned in a section of the stock inlet pipe, restrictions are avoided which are imposed by having the attenuator integral with the headbox distributor. In that arrangement, the attenuator extended for the width of the machine. In the present arrangement the attenuator diaphragm extends for the full width of the flow, forming one complete wall of the rectangular flow chamber. An attenuator diaphragm on the order of 6' long may be used and will give the diaphragm sufficient exposure to the stock flow and provide a size of air chamber large enough to provide a desired amount of yield or give in the diaphragm. The quicker and easier the diaphragm reacts to surge pressure pulsations, the more effective it will be. Yet, with the division of the air chamber into compartments and an attenuator arrangement between compartments so as to provide a relatively more shallow diaphragm support compartment, effective control of surges is attained without danger of introducing fluctuations due to air surges or flutter or unstable conditions.

Figure 7:
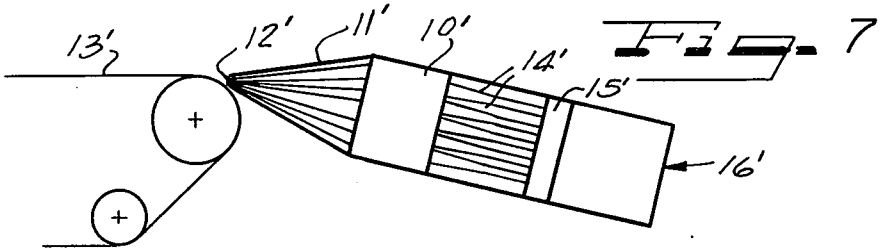
FIG. 7 is a somewhat schematic side elevation illustrating a paper machine stock supply system.

Another form of the invention is illustrated in FIGS. 7 through 13. As illustrated in FIG. 7, a headbox 10' is shown in a stock supply system for distributing stock onto a moving forming wire 13'. The stock is delivered from the headbox through a slice chamber 11' to a slice opening 12'. The requirement for the system is to obtain continual uniform dispersion of the fibers throughout the stock and to obtain uniform flow of the stock in a cross-machine direction and a uniform rate of flow in a machine direction. To accomplish this, the stock must reach the headbox without fluctuation in pressure which is accomplished by the attenuation structure and rearrangement of the present invention.

Figure 8:
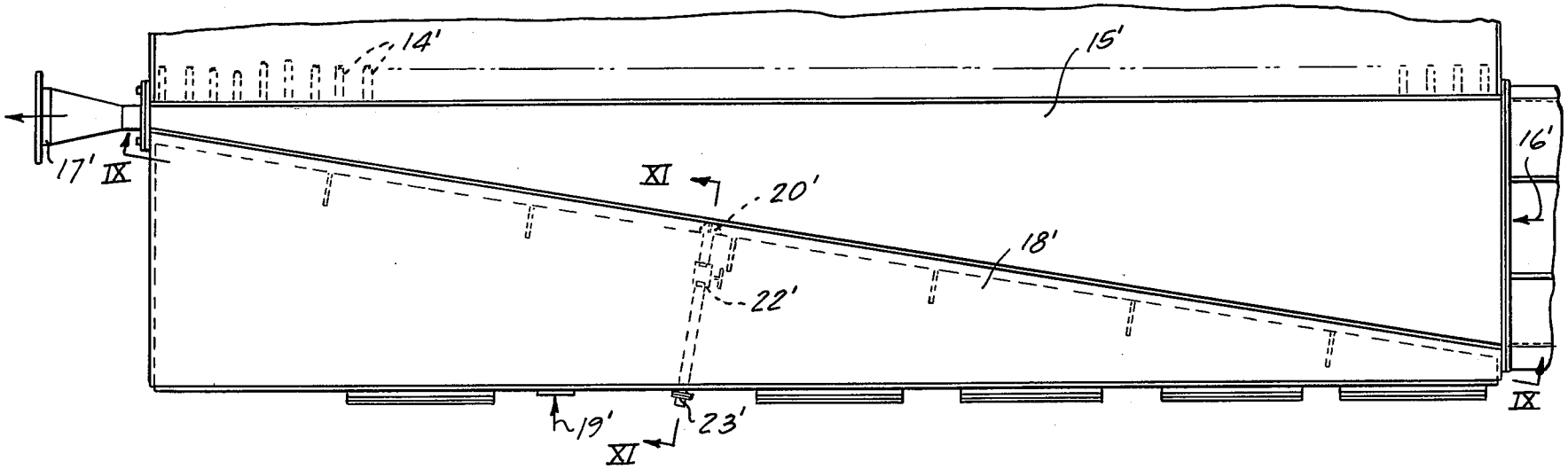
FIG. 8 is a sectional view showing a tapered stock distributor embodying the features and principles of the present invention.

The stock is delivered to the headbox chamber 10' to a plurality of tubes 14' which are uniformly distributed across the width of the machine. To obtain uniform velocity of flow through the tubes 14', stock is delivered to the tubes through a tapered distributor pressure stock chamber 15' which is supplied with stock through a supply line 16' from a fan pump. In known arrangements circulation is maintained through the pressure distributor chamber 15' by flow out of the small tapered end through a discharge line 17', as illustrated in FIG. 8. In this figure, the number of tubes 14' are not shown in their entirety, but a substantial number exists, and it is essential for uniform delivery of these tubes that pressure fluctuations caused by operation of the fan pump and other equipment be dampened. This is accomplished by connecting an air pressure chamber 18' directly to the pressurized stock distribution chamber 15'. In a preferred arrangement, a flexible diaphragm 21' forms a common wall between the air chamber and the pressure stock distribution chamber 15' with the diaphragm transmitting the pressure surges and fluctuations to the air chamber which functions to attenuate the surges. The air chamber 18' is pressurized with an initial pressure through a supply line 19', FIG. 8, dependent upon the pressure of the stock which will be delivered to the pressure distribution chamber 15'. In accordance with the invention, the air chamber is pressurized to a pressure slightly greater than the pressure in the stock chamber 15' or at least as great as the pressure in the stock chamber. A valve 20' is constructed and arranged so that it will bleed pressure out of the air chamber as a function of movement of the diaphragm until the diaphragm reaches the operative position whereupon it will close the bleed valve 20'. With any drop in pressure in the stock chamber 15', movement of the diaphragm will again open the valve 20' to provide additional air to bleed out.

Preferably, the supply line 19' will maintain a continuous supply to the air chamber 18' at a predetermined reference pressure which will be equal to the pressure of the stock in the stock chamber. Normally, a continual flow of air will be maintained into the air chamber similar to the operation of the fitting at 29' described in connection with the structure and operation of the unit in FIGS. 7 through 13.

The distance between the diaphragm and the valve is controlled by a valve positioning jack 22' which moves the valve 20' toward or away from the diaphragm 21', and this operation will be understood more clearly in connection with the detailed showing in FIG. 11. The valve 20' leads down through an air bleed pipe which opens at 23', FIG. 8, to release air from the air chamber 18'.

The support for the diaphragm 21' is arranged so that it is clamped at its edges by angle clamps 27', FIG. 10. The surface of the diaphragm is thus directly exposed to the stock pressure chamber 15', and preferably the mechanism is operated so that the diaphragm 21' bulges slightly toward the stock pressure chamber 15.

The diaphragm is supported underneath by a resilient material such as sponge 27' which absorbs vibration of the diaphragm and provides a yieldable support. The diaphragm is preferably made of material such as neoprene, and it will be noted that a smooth flow face is presented to the stock pressure chamber which does not interfere with the flow so that the distribution chamber 15' can take its normal optimum design.

Figure 9:
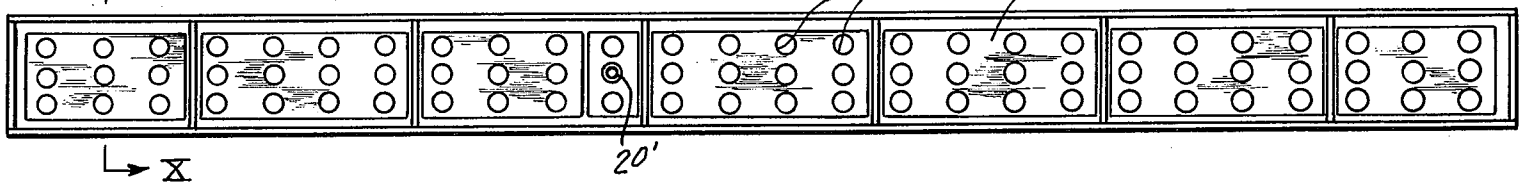
FIG. 9 is a sectional view taken substantially along line IX—IX of FIG. 8.

Beneath the diaphragm 21', the air chamber is divided into a plurality of circular compartments 25'. Thus, the main air chamber is, in essence, divided into two compartments, a first compartment 25' adjacent the diaphragm, and a second larger compartment 26', and a dampening wall 29' extends between the compartments. This arrangement aids in stabilization of the pressure dampening and prevents flutter of the diaphragm and aids in the dampening or attenuation function. The dampening wall 29' is clamped between annular clamping rings **29*a'* and 29*b'* as shown in FIGS. 9 and 10. As illustrated in FIG. 13, the air flow dampening wall 29' is constructed by a perforated plate 30' having perforations 31' therethrough and supporting a felt 32'. The felt slows or dampens the flow of air from the small compartments 25' to the main compartment 26' of the air chamber 18'** so as to further aid in the attenuation of the pressure surges in the stock chamber.

FIGS. 11 and 12 show the valve 20' in further detail. The head of the valve 33' coacts with the diaphragm to relieve air from the air pressure chamber 18'. Passageways 36' communicate with the air pressure chamber, and a central passageway 37' through the center of the valve leads to atmosphere. Flow of air from the pressure chamber from the radial passages 36' to the center passage 37' is prevented by the diaphragm resting on the top of the annular land 35'. Outside of the land is an annular channel 34' with which the radial passages 36' communicate. Whenever the diaphragm tends to move away from the valve head, air escapes over the top of the land 35' from the pressure chamber, and as the pressure in the pressure chamber drops, the entire diaphragm, of course, will again seat on the land 35'. By maintaining the top of the land relatively narrow, a good response will be attained.

Thus, the diaphragm provides an attenuation surface which is exposed substantially uniform across the entire width of the headbox to the distribution pressure chamber. While in the preferred arrangement the air attenuation chamber is directly connected to the stock pressure chamber, and advantages are obtained by this structure, the attenuation system could be connected to other parts of the stock system either upstream or downstream of the tapered pressurized distribution chamber.

With the present arrangements, a broad range of frequencies are attenuated, and these broad ranges are encountered due to inherent requirements of the design of the paper machine stock supply pressure system. A low mass large area diaphragm accomplishes the attenuation and coacting with the dampening of the flow of air between the compartments of the air chamber, it is wholly effective. The arrangement handles expeditiously the surges caused by rotational frequency of a constant speed centrifugal pump which has heretofore been a problem. Also, the only moving part, which is the attenuating diaphragm, is smooth and forms a portion of the stock chamber wall so that no projections or recesses are formed which would tend to adversely affect the stock flow and cause fibers to gather. The operating valve parts are exposed only to air and thus, do not need servicing or cleaning. It has been found that the structure meets the objectives and advantages above set forth and solves problems encountered in existing and newly designed paper machine stock distribution systems. The surges and fluctuations in pressure which are in part in the form of compressional waves have been a problem in reduction of quality of the web formed. With the elimination of these compressional waves, more uniform basis weight formation can be achieved and improved fiber distribution and reduction of flocculation result. Elimination of compressional waves eliminates variations in velocities, and therefore, insures a more uniform product.

I claim as my invention:

1. In a paper machine stock supply system, the combination comprising:

a stock supply pump connected for delivering a continuous flow of stock under pressure;

a slice chamber leading to a slice opening;

a stock supply flow system for conducting stock from the supply pump to the slice chamber;

an air pressure chamber positioned adjacent said stock flow system;

a flexible diaphragm forming a wall of said stock supply system in direct flow contact with stock flowing from the pump to the slice chamber for dampening pressure fluctuations in the stock in said system and being supported by the air in said pressure chamber;

means for continually delivering the air under pressure to said air chamber;

and an air valve communicating with the air chamber having an outlet port controlled by the position of said diaphragm so that increases in pressure in the stock flow system will restrict flow through the port and decreases in the system will increase flow through said port.

2. In a paper machine stock supply system constructed in accordance with claim 1, the combination:

wherein said air chamber has a supply compartment and has a diaphragm support compartment with damping means restricting flow between said compartments and said air delivery means connected to said supply compartment.

3. In a paper machine stock supply headbox system for conducting stock from a supply pump to a slice opening, the combination comprising:

a conduit means for conducting stock from a supply pump to a slice opening;

a diaphragm of flexible material forming a flexible wall of said conduit;

a pressure chamber having one wall formed of said diaphragm with said chamber containing air under pressure in direct contact with the diaphragm so that pressure fluctuations in the conduit means will be absorbed by the diaphragm; and means for supplying air at a predetermined air pressure to said pressure chamber.

4. In a paper machine stock supply system for conducting stock from a supply pump to a slice opening constructed in accordance with claim 3, the combustion comprising:

a valve for releasing air from the pressure chamber operated in response to movement of the diaphragm toward the conduit means.

5. A paper machine stock supply system for conducting stock from a supply pump to a slice opening constructed in accordance with claim 3:

wherein said conduit means is rectangular and said diaphragm forms a complete wall extending the full width of the conduit means transversely of the direction of flow of stock in the conduit.

6. A paper machine stock supply system for conducting stock from a supply pump to a slice opening constructed in accordance with claim 3:

including an air release valve in the pressure chamber having a port for exhausting air to atmosphere with said port positioned to be engaged by the diaphragm and opened as the diaphragm moves away from the port in response to decreases in pressure in the conduit means.

7. In a paper machine stock supply headbox system for conducting stock from a supply pump to a slice opening, the combination comprising:

a conduit means through which stock flows under pressure to a slice opening;

a diaphragm of flexible material forming a wall for the conduit means in direct contact with stock flowing therein;

a pressure damping air chamber having a diaphragm support compartment for containing air providing overall support for the diaphragm and a supply compartment in communication with said support compartment;

and an attenuation wall between said compartments attenuating the flow of air therebetween.

8. A paper machine stock supply system for delivering paper stock from a supply pump through a slice opening constructed in accordance with claim 7:

wherein said attenuation wall includes a plate extending between compartments with openings through said plate and attenuation material in said openings and having plug means for selectively closing said openings.

9. A paper machine stock supply system for delivering paper stock from a supply pump through a slice opening constructed in accordance with claim 7:

including a pressure relief valve in said support compartment with a port exposed to the diaphragm so that as the diaphragm moves away from the port with decrease in pressure in the conduit means air is bled from the support chamber to atmosphere.

10. A paper machine stock supply system for delivering paper stock from a supply pump through a slice opening constructed in accordance with claim 7:

wherein the conduit means is circular in cross-section and is provided with a length rectangular in cross-section with said diaphragm forming one complete wall of the length of rectangular cross section and including an attenuation wall separating the support compartment from the supply compartment formed of a material limiting air flow through the attenuation wall;

means for continually supplying air at a predetermined pressure to said supply compartment; and a pressure relief valve leading to atmosphere having a port controlled by the position of the diaphragm and increasing in opening as the diaphragm moves toward the conduit means with decrease in stock pressure therein.

11. In a paper machine stock supply system for delivering paper stock from a supply pump through a slice opening constructed in accordance with claim 10, comprising in combination:

and including a second pressure relief valve also having a port with an opening variable as a function of position of the diaphragm.

12. The method of dampening pressure surges in a supply system for conducting paper stock through a stock conduit under pressure to a slice opening which comprises:

absorbing pressure fluctuations by transmitting the fluctuations to an air chamber through a diaphragm wall of flexible material positioned as a wall of the stock conduit;

dividing the chamber into a support compartment directly exposed to the entire diaphragm and a supply compartment with an air flow attenuation wall between the compartments and continually supplying air at a predetermined pressure to the supply compartment.

13. The method of dampening pressure surges in a stock pressure supply system in accordance with the steps of claim 12 comprising:

relieving air pressure from the support compartment as the diaphragm wall moves toward the conduit means through which the stock flows.

14. A paper machine stock supply system for conducting stock from a supply pump to a slice opening constructed in accordance with claim 3:

wherein said conduit means is circular in cross-section and conversion means is provided to convert to a rectangular cross-section with said diaphragm forming one complete wall of the rectangular cross section.

15. A paper machine stock supply system for conducting stock from a supply pump to a slice opening constructed in accordance with claim 4:

wherein said release valve has a head with a port facing the diaphragm so that the port opening increases with movement of the diaphragm toward the conduit means.

16. In a paper machine headbox system, the combination comprising:

a stock headbox leading to a stock distribution slice opening for distributing stock onto a traveling forming surface;

a plurality of flow tubes distributed across the headbox and connected to deliver stock to the headbox;

an elongate tapered stock distributing supply chamber for receiving stock under pressure with the flow tubes connected thereto;

a stock supply pump connected for delivering a continuous flow of stock under pressure to the large end of the supply chamber;

an air pressure chamber;

a diaphragm of flexible material exposed to the stock flowing through the supply chamber forming a common wall between said stock supply chamber and said air chamber;

an air valve communicating with the air chamber having an outlet port controlled by said diaphragm so that increases in pressure in said stock chamber will restrict flow through said port and decreases will increase the flow through said port;

and means for delivering air under pressure to said air chamber at a predetermined reference pressure.

17. In a paper machine headbox system constructed in accordance with claim 16:

a main air chamber communicating with said valve controlled air chamber;

and a dampening means restricting flow between said air chambers to damp movement of said diaphragm.

18. In a paper machine headbox system having a stock supply pressure chamber with flow tubes leading to a distribution system having a slice opening with means for delivering stock under pressure to the pressure chamber, in accordance with claim 17:

wherein said damping means includes a perforate plate extending between air chambers supporting a layer of flow damping material.

* * * * *